United States Patent [19]

Fratangelo

[11] Patent Number: 4,669,719

[45] Date of Patent: Jun. 2, 1987

[54] SHEET ROTATION AND REGISTRATION VERTICAL TRANSPORT

[75] Inventor: Louis D. Fratangelo, Fairport, N.Y.

[73] Assignee: Xerox Corporation, Stamford, Conn.

[21] Appl. No.: 869,621

[22] Filed: Jun. 2, 1986

[51] Int. Cl.[4] ..... B65H 9/16

[52] U.S. Cl. ..... 271/251; 271/185; 271/273

[58] Field of Search ..... 271/250, 251, 273, 274, 271/184, 185

[56] References Cited

U.S. PATENT DOCUMENTS

| | | | |
|---|---|---|---|
| 2,190,413 | 2/1940 | Davidson | 271/49 |
| 2,190,416 | 2/1940 | Davidson | 271/49 |
| 2,219,892 | 10/1940 | Gibson | 271/251 |
| 4,030,724 | 6/1977 | Goodwin | 271/184 X |
| 4,314,644 | 2/1982 | Stocker | 271/184 X |
| 4,456,116 | 6/1984 | Jarman | 198/414 |

FOREIGN PATENT DOCUMENTS

| | | |
|---|---|---|
| 1103356 | 3/1961 | Fed. Rep. of Germany . |

*Primary Examiner*—Richard A. Schacher
*Attorney, Agent, or Firm*—William A. Henry, II

[57] ABSTRACT

A sheet rotation and registration vertical transport includes the combination of a belt conveyor and a series of housed free floating balls arranged such that the balls selectively retard one side of a sheet moving along the conveyor, thereby causing the sheet to rotate 90° due to the pull of gravity against the sheet.

12 Claims, 4 Drawing Figures

SHEET ROTATION AND REGISTRATION VERTICAL TRANSPORT

BACKGROUND OF THE INVENTION

This invention relates to transport of copy sheets in a copier or printer, and more particularly, to a system for rotating sheets as they are traveling vertically on a transport apparatus.

When documents that are size A3 or 11"×17" are placed onto the platen of some copiers for reduction copies to be made from the documents onto smaller sized copy sheets (e.g., 8½"×11"), the copy sheets must be rotated 90° before they receive images from the documents.

Systems in the past have been able to rotate materials for different reasons by the use of costly, cumbersome and complicated mechanisms and devices. For example, U.S. Pat. Nos. 2,190,413 and 2,190,416 show a ball-on-belt transport that provides 90° rotation of paper in a folding machine. A ball track is included that appears to be primarily a guide, with the actual rotation of a paper being caused by a shoulder which the paper strikes as it moves along the belt of the transport system. In U.S. Pat. No. 4,445,116 front feed equipment for facilitating the feeding of sheet metal into the cutting area of shear equipment is shown that teaches rotating a piece of metal by selectively adjusting the pressure applied between a plurality of rollers and balls. German Pat. No. 1,103,356 is directed to a device for conveying and at the same time aligning individual sheets along an aligning guide using a conveyor belt which is inclined slightly with respect to the direction of paper travel and has a number of feeding moving spheres in cages. The heretofore mentioned sheet transport systems do not appear to be adaptable to the rotation of sheets in a copier due to their bulkiness, complicated mechanisms and cost.

SUMMARY OF THE INVENTION

Accordingly, a rotational registration vertical transport for a copier or the like is provided that is adapted to rotate a vertically traveling sheet 90° and includes a belt transport and a series of separate sets of matching rollers positioned opposite the belt. One set of rollers is free floating to allow rotation of the sheet and others are used only when the sheet is to be held straight. When the latter rollers are moved away from a sheet holding position to a non-holding position the sheet is rotated by gravity.

BRIEF DESCRIPTION OF THE DRAWINGS

The above-mentioned features and others of the invention together with the manner of obtaining them will best be understood by making reference to the following specification in conjunction with the accompanying drawings, wherein.

DETAILED DESCRIPTION OF THE PREFERRED EMBODIMENT

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
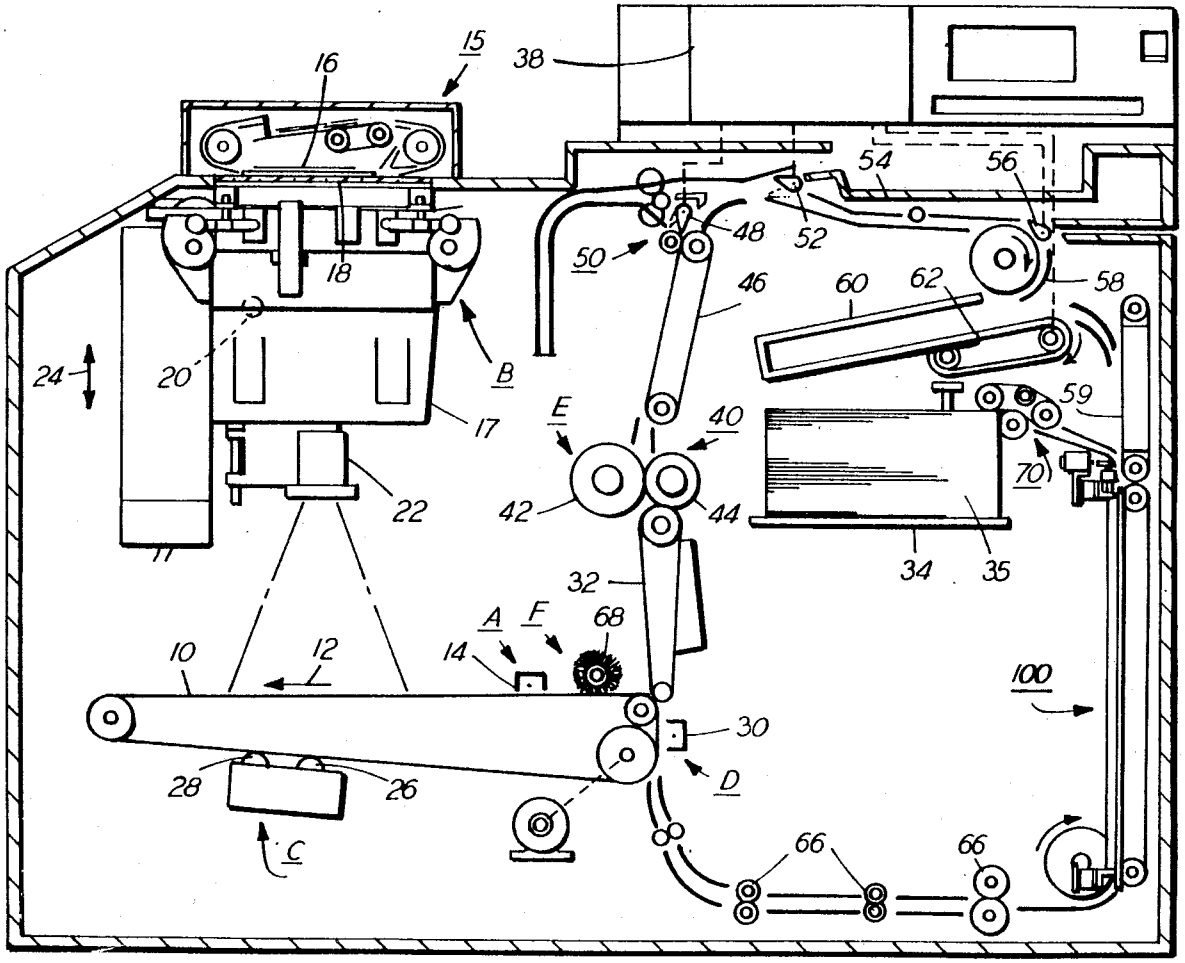
FIG. 1 is a schematic elevational view showing an electrophotographic copier employing the features of the present invention.

For a general understanding of the features of the present invention, reference is had to the drawings. In the drawings, like reference numerals have been used throughout to designate identical elements. FIG. 1 schematically depicts the various components of an illustrative electrophotographic copying machine incorporating the rotational registration vertical transport apparatus of the present invention therein.

Inasmuch as the art of electrophotographic copying is well known, the various processing stations employed in the FIG. 1 copying machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the information areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a copying or printing machine which does not include a document handling unit, or when one is making copies of A3 or 11"×17" documents where the document handler has to be raised up from the platen and the oversized document manually placed on the platen for copying.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from tray 34 to transfer station D. The tray senses the size of the copy sheets and sends an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carries it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed to conveyor 59 seriatim by bottom feeder 62 back to transfer station D for transfer of the toner powder image to the opposed side of the sheet. Conveyors 100 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with the photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

Figure 2:
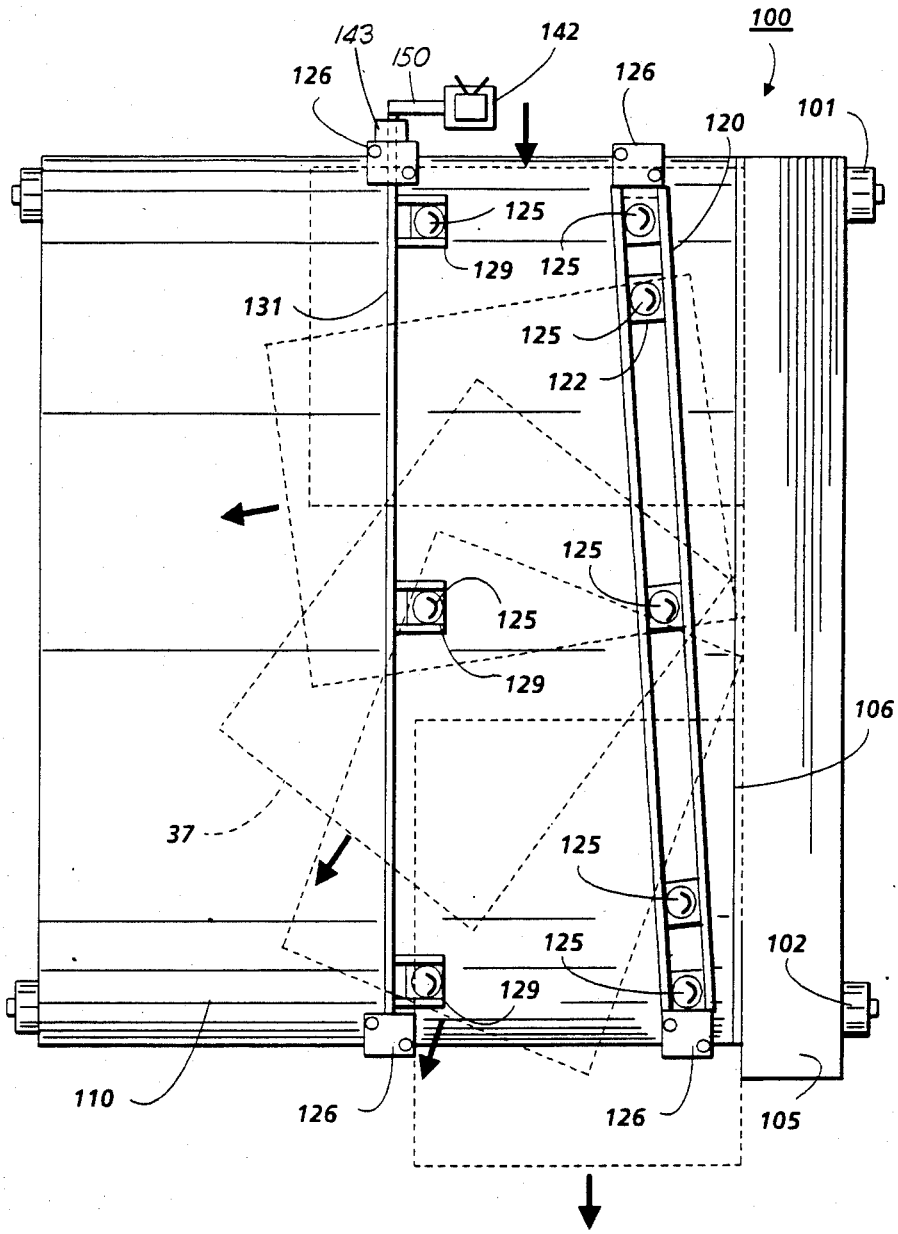
FIG. 2 is a partial plan view of the vertical transport of FIG. 1.
Figure 3:
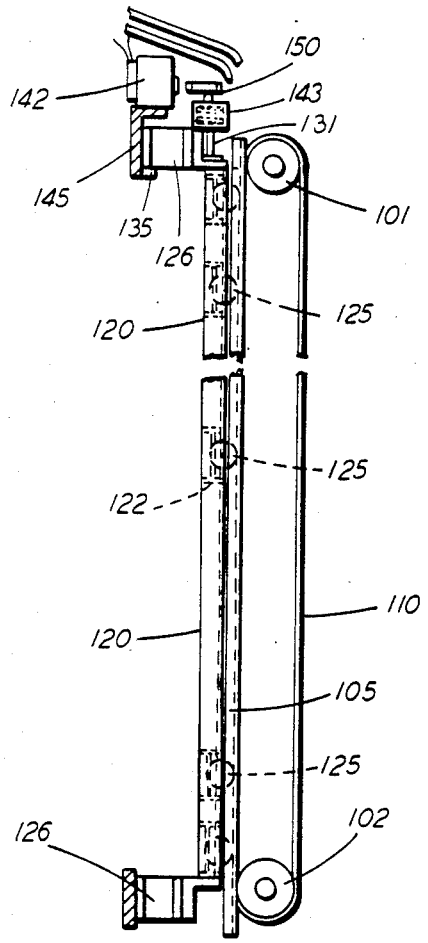
FIG. 3 is a partial right hand side view of the rotational registration vertical transport shown in FIG. 1.
Figure 4:
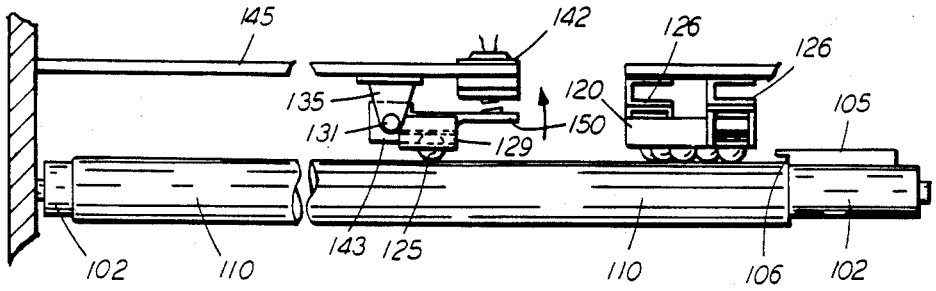
FIG. 4 is a partial front elevational view of the vertical transport of FIG. 2.

Turning now to an aspect of the present invention, a transport device 100 adapted to rotate a vertically traveling sheet 90° is shown in FIGS. 2–4. The machine controller 38 will control the operation of transport device 100 depending upon what is selected at the machine console by the operator as will be explained in more detail hereinafter. As seen in FIGS. 2–4, and particularly FIG. 2, transport device 100 includes a sheet transport belt 110 that receives copy sheets from tray 34 and is vertically orientated with reference to a horizontal plane. The belt 110 is rotatably supported by shaft members 101 and 102 that are supported by the machine frame. A guide and sheet registration member 105 has an overhanging lip 106 more clearly seen in FIG. 2 that allows sheets to be registered thereagainst. A channeled member 120 that is supported by support member 126 has housing 122 connected thereto which support balls 125 and allows them to float on top of belt 110. The positioning of the balls in relation to the belt will allow a sheet situated between the two to rotate freely due to gravity acting on the sheet. Also, channel member 120 is obliquely positioned with respect to the vertical plane of the transport belt and with respect to registration guide member 105. This positioning of channel member 120 will cause balls 125 and belt 110 to direct sheets passing therebetween toward registration guide member 105. A second set of free floating balls 125 are adapted to rotate in housings 129 which themselves are adapted to be rotated by shaft 131. Brackets 135 support shaft 131 which in turn is supported by a support member 145 that is connected to the machine frame. An electro-magnetic switch 142 is also supported by support member 145. Actuation of magnetic switch 142 will cause arm 150 to rotate shaft 131 which in turn causes housing 129 to rotate away from belt 110. Actuation of magnetic switch 142 is controlled by controller 38. Torsion spring box 143 holds housing 129 against belt 110 normally. Once magnetic switch 142 is deactuated, torsion spring box 143 brings the housing 129 back down against belt 110 for normal operation.

In operation, an A3 or 12"×17" document is placed on the platen of the copier and reduction is selected by the operator. Since this reduction will require that the copy sheets in tray 34 be reoriented from long edge (landscape) feed to short edge (portrait) feed or turned 90°, the microprocessor or controller 38 will be ready to enable magnetic switch 142. Therefore, after a copy sheet 37 is fed past the first balls in channel member 120 and housing 129, respectively, magnetic switch 142 is actuated by the microprocessor which causes the contact of the magnetic switch to close thereby rotating housing 129 that has one of the contacts of the magnetic switch attached to it. This rotation of housing 129 lifts balls 125 off of the surface of sheet 37. As a result, gravity pull on the sheet will cause it to rotate as seen in phantom lines in FIG. 2 as it continues traveling down belt 110 and the angling of channel member 120 in conjunction with belt 110 serves to register the sheet against registration edge guide 105. This process is repeated for each reduced copy required of the original document.

It should now be understood that an apparatus adapted to rotate a sheet 90° while traveling in a vertical plane is disclosed and includes the combination of a belt conveyor and a series of free floating balls arranged such that the balls selectively retard one side of a piece of paper moving along the conveyor, thereby causing the paper to rotate 90°.

What is claimed is:

1. A sheet rotating apparatus adapted to rotate a sheet traveling downward in a vertical plane, comprising:

a vertically positioned belt transport and a first set of sheet holddown balls positioned opposite said belt transport and adapted to hold sheets against said belt transport with a minimum of normal force, said first set of balls being positioned obliquely with respect to said vertical plane so that sheets traveling between said first set of balls and said belt transport will be urged toward an edge of said belt transport, and a second set of balls adjacent to and removed from said first set of balls, said second set of balls being adapted when in a first position to hold sheets against said belt transport and when in a second position allows sheets to be held against said belt transport only by said first set of balls, such that gravity and the rotation of said belt transport will cause sheets traveling on said belt transport to rotate 90°.

2. The sheet rotating apparatus of claim 1, wherein the rotation of a sheet is from landscape to portrait.

3. The sheet rotating apparatus of claim 1, wherein said second set of balls initially contact a sheet while in said first position.

4. In a copier having means for making reduced images of documents on copy sheets, the improvement of:

a sheet rotating apparatus adapted to rotate a sheet traveling downward in a vertical plane, including a vertically positioned belt transport and a first set of sheet holddown balls positioned opposite said belt transport and adapted to hold sheets against said belt transport with a minimum of normal force, said first set of balls being positioned obliquely with respect to said vertical plane so that sheets traveling between said first set of balls and said belt transport will be urged toward an edge of said belt transport, and a second set of balls adjacent to and removed from said first set of balls, said second set of balls being adapted when in a first position to hold sheets against said belt transport and when in a second position allows sheets to be held against said belt transport only by said first set of balls, such that gravity and the rotation of said belt transport will cause sheets traveling on said belt transport to rotate 90°.

5. The sheet rotating apparatus of claim 4, wherein the rotation of a sheet is from landscape to portrait.

6. The sheet rotating apparatus of claim 4, wherein said second set of balls initially contact a sheet while in said first position.

7. In a printing apparatus that is adapted to make copies of document information onto copy sheets, the improvement:

characterized by a sheet rotating apparatus that includes a vertically positioned belt transport and a first set of copy sheet holddown balls positioned opposite said belt transport and adapted to hold copy sheets against said belt transport with a minimum of normal force, said first set of balls being positioned obliquely with respect to said belt transport so that copy sheets traveling between said first set of balls and said belt transport will be urged toward an edge of said belt transport, and a second set of balls adjacent to and removed from said first set of balls, said second set of balls being adapted when in a first position to hold copy sheets against said belt transport and when in a second position allows copy sheets to be held against said belt transport only by said first set of balls, such that gravity and the rotation of said belt transport will cause copy sheets traveling on said belt transport to rotate 90°.

8. The printing apparatus of claim 7, wherein the rotation of a copy sheet is from landscape to portrait.

9. The printing apparatus of claim 7, wherein said second set of balls initially contact a copy sheet while in said first position.

10. The printing apparatus of claim 9, wherein actuation of a magnetic switch causes said second set of balls to pivot into said second position.

11. The printing apparatus of claim 10, wherein torsion spring means returns said second set of balls to said first position upon deactuation of said magnetic switch.

12. The printing apparatus of claim 8, wherein said first set of balls and said belt transport drives copy sheets against a vertical straight edge.

* * * * *